US008042297B2

(12) United States Patent
Emde

(10) Patent No.: US 8,042,297 B2
(45) Date of Patent: Oct. 25, 2011

(54) MAGAZINE FOR A HANDHELD FIREARM

(75) Inventor: Dietmar Emde, Arnsberg (DE)

(73) Assignee: German Sport Guns GmbH, Ense-Hoingen (DE)

( * ) Notice: Subject to any disclaimer, the term of this patent is extended or adjusted under 35 U.S.C. 154(b) by 0 days.

(21) Appl. No.: 12/530,298

(22) PCT Filed: Mar. 6, 2008

(86) PCT No.: PCT/EP2008/001790

§ 371 (c)(1), (2), (4) Date: Mar. 1, 2010

(87) PCT Pub. No.: WO2008/110296

PCT Pub. Date: Sep. 18, 2008

(65) Prior Publication Data

US 2010/0299986 A1 Dec. 2, 2010

(30) Foreign Application Priority Data

Mar. 9, 2007 (DE) ..... 10 2007 011 502

(51) Int. Cl.
*F41A 9/61* (2006.01)

(52) U.S. Cl. ..... 42/49.01; 42/50

(58) Field of Classification Search ..... 42/49.01, 42/50, 49.1, 18, 22, 29, 35, 37; 89/33.1
See application file for complete search history.

(56) References Cited

U.S. PATENT DOCUMENTS 5,502,913 A * 4/1996 Jackson ..... 42/50

FOREIGN PATENT DOCUMENTS

EP 0461784 * 12/1991

* cited by examiner

*Primary Examiner* — J. Woodrow Eldred
(74) *Attorney, Agent, or Firm* — Mannava & Kang, PC

(57) ABSTRACT

The present invention relates to a magazine (10) for a handheld firearm, suitable for accommodating a plurality of cartridges (11, 12, 13, 14) which are transported in a guided movement by means of a feed within the magazine in the direction of the barrel of a weapon, in order to be loaded individually in each case into the barrel of the weapon at the upper end of the magazine after each shot, with the cartridges being guided along a curved path in the magazine. When using cartridges with a firing rim (19), in order to ensure that these cartridges are emitted at the upper end of the magazine such that the firing rim of the uppermost cartridge (14) is always in front of that of the second-uppermost cartridge (13), the invention provides that the internal contour of the magazine (10) is designed, at least in an area at a distance from the upper magazine end, such that successive cartridges assume an interlaced arrangement with crossing axes, the internal contour tapers toward the upper end of the magazine such that the cartridges are aligned, and that the firing rim (19) of at least the uppermost cartridge (14) is guided by guide elements in the magazine.

9 Claims, 4 Drawing Sheets

MAGAZINE FOR A HANDHELD FIREARM

The present invention relates to a magazine for a handheld firearm, in particular a semi-automatic pistol, suitable for accommodating a plurality of cartridges which are transported in a guided movement by means of a feed within the magazine in the direction of the barrel, in order to be loaded individually in each case into the barrel of a weapon at the upper end of the magazine after each shot, with the cartridges being guided along a curved path in the magazine.

By way of example, a magazine of the abovementioned type is known from U.S. Pat. No. 5,502,913. Magazines of this type are used in repeating weapons which are intended for cartridges with a projecting firing rim. Since the diameter of the cartridge is in each case broader in the area of the firing rim than in the rest of the area of the casing, this means that, when there are a plurality of cartridges located one above the other in the longitudinal direction of the magazine, a type of curved path is formed, and the magazine must be designed to be correspondingly curved. One problem with this type of magazine results from the fact that, when the magazine contains a relatively large number of cartridges, the upper end of the curved magazine assumes an angle of less than 90° to the barrel, which has a disadvantageous effect for the loading of a cartridge with a firing rim.

A further difficulty is that the cartridges may be located in an unorganized form within the magazine with regard to the respective position of the firing rim of adjacent cartridges. In order to allow the uppermost cartridge to be loaded into the barrel, however, it is absolutely essential to ensure that the cartridge rims of the upper cartridges are always located one behind the other, to be precise in a staggered arrangement in which the firing rim of the uppermost cartridge is in front of that of the second-most cartridge in the firing direction.

If, in contrast, rimless cartridges are used, it is also possible to use magazines in which the feed path of the cartridges follows a straight line. In addition, the abovementioned problems in loading of the cartridges into the barrel do not occur here.

By way of example, reference is made here with regard to the prior art to DE 195 01 397 A 1 which describes a straight magazine such as this for cartridges without a firing rim.

The object of the present invention is to provide a magazine for a handheld firearm of the generic type mentioned initially, which ensures that, when using cartridges with a firing rim, these cartridges are emitted at the upper end of the magazine such that the firing rim of the uppermost cartridge is always located in front of that of the second-uppermost cartridge in the firing direction.

This object is achieved by a magazine for a handheld firearm of the generic type mentioned initially having the characterizing features of the main claim.

The invention provides that the internal contour of the magazine is designed, at least in an area at a distance from the upper magazine end, such that successive cartridges assume an interlaced arrangement with crossing axes, the internal contour tapers toward the upper end of the magazine such that the cartridges are aligned, and that the firing rim of at least the uppermost cartridge is guided by guide elements in the magazine. The cartridges are thus first of all interlaced in a lower area, that is to say, in the ideal case, the cartridges are always aligned there alternately further to the right or further the left longitudinal wall of the internal area of the magazine. If this quasi-ideal alignment is not achieved, and the cartridges are located in a somewhat unorganized manner in this area, this is, however, not critical for the solution according to the invention. In an area located further upward, the internal area of the magazine then becomes narrower as a result of which the cartridges are forced into a position in which they are finally located approximately one above the other, with axes aligned approximately parallel. The unobstructed width of the internal area of the magazine is accordingly reduced such that, at the top, it only in each case has sufficient width for one cartridge. This arrangement should preferably be provided at least for the two uppermost cartridges. Furthermore, the firing rim of the uppermost cartridges is guided by guide elements in the magazine and/or its internal contour such that this results in the two uppermost cartridges being in a staggered (in the longitudinal direction) position, thus allowing the uppermost cartridge to be emitted at the upper end of the magazine such that its firing rim is not impeded by that of the cartridge located underneath it, and the uppermost cartridge can therefore enter the firing channel in a controlled manner.

One preferred development of the problem solution according to the invention provides that the internal contour of the magazine tapers conically in an upper transitional area by means of ramps or inclines. In this case, preferably, the internal contour of the magazine tapers to approximately the width of a cartridge in an upper transitional area at a distance from the upper magazine end, starting from a broader area which is located further below. In the lower area of the magazine, which may extend quite a long distance upward, the cartridges accordingly initially have space for the interlaced arrangement, but are then effectively aligned some distance before the upper end of the magazine, whose internal area is then narrower, and are finally located virtually one above the other with axes that are aligned largely in the same way.

One preferred variant of the problem solution according to the invention provides that the firing rim of the uppermost cartridge or of the plurality of upper cartridges is guided so as to achieve the desired staggered arrangement of the firing rims of the cartridges, for example by means of a fillet which at least partially holds the firing rim. Furthermore, for example, a stud can be arranged approximately at the upper end of the fillet, which bounds the fillet at the front, with the firing rim of the uppermost cartridges passing this stud and with the firing rim being released as they are fed further, allowing the cartridge to be loaded into the firing channel. The rear boundary of the fillet may, for example, form a guide web on which the bottom of the cartridge rests. Furthermore, the fillet can preferably taper toward its upper end and, furthermore, the guide web can run on a curved line in the upper area, as a result of which the firing rim of the uppermost cartridge is forced forward, that is to say in the firing direction, before leaving the fillet.

According to one development of the problem solution according to the invention, a contour lip is fitted as a guide element to the upper end of the magazine and at least partially surrounds the circumference of at least one cylindrical section of the uppermost cartridge. Once the firing rim has left the fillet and/or has passed the stud, the cartridge in this preferred variant enters an area in which it is partially surrounded by the contour lip and is held until it is driven by an element of the breech and is loaded into the firing channel.

The features mentioned in the dependent claims relate to preferred developments of the problem solution according to the invention. Further advantages of the invention result from the following detailed description.

The present invention will be described in more detail in the following text using exemplary embodiments and with reference to the attached drawings, in which.

First of all reference will be made to FIG. 1. The illustration shows a side view of a magazine 10 according to the invention. As can be seen, the outer contours 15, 16*a* of the magazine follow a curved line. This is because the magazine holds cartridges which are not illustrated here, which have a firing rim and are therefore broader at the end with the firing rim than in the center. In consequence, cartridges such as these are located one above the other in the magazine such that their arrangement follows a circular arc in the feed direction of the magazine. These relationships and magazines of this type are known.

Figure 2:
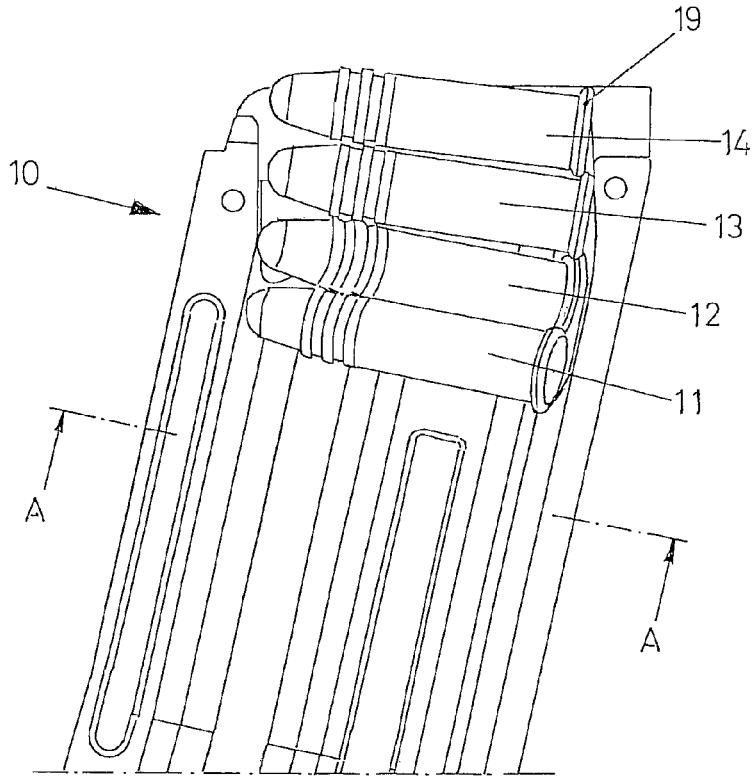
FIG. 2 shows a section view through the magazine in the longitudinal direction, showing the uppermost cartridges.

FIG. 2 shows a longitudinal section through the magazine 10, with a plurality of cartridges 11, 12, 13, 14 being shown in the upper area, in order to illustrate the invention. The figure shows the interleaved arrangement of the two lower cartridges 11 and 12 which are located in the magazine such their axes cross approximately in a central area. This interleaved arrangement of the two cartridges 11 and 12 can also be seen in the section illustration in FIG. 3, which shows a cross section through the magazine.

Figure 3:
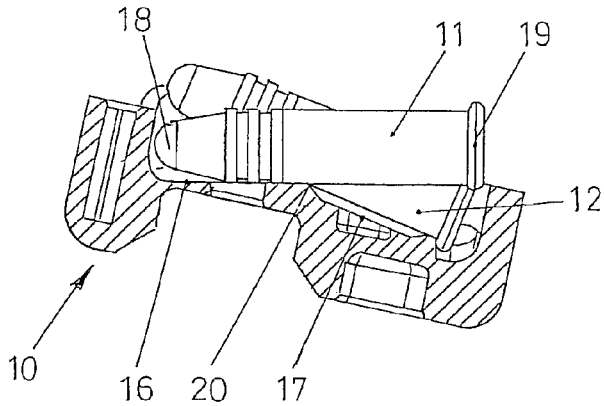
FIG. 3 shows a further section view through the magazine in the lateral direction along the line A-A from FIG. 2.

The internal contour of the magazine 10 will be explained in the following text with reference to FIG. 3, resulting in the interleaved position of the cartridges 12 with axes which cross approximately in a central area of the internal area of the magazine. As can be seen in FIG. 3, the internal width in the lateral direction decreases in each case from both sides toward the center. On both sides of the center, there is a respective incline 16, 17 on the longitudinal side wall, such that the magazine has its smallest unobstructed width in the lateral direction approximately in the center 20. The cartridges 11, 12 which are located one above the other are thus arranged such that they are in each case aligned alternately with the tip 18 toward one side and the other side. The two inclines 16, 17 effectively act like a rocker for the cartridges 11, 12 located in the magazine, ensuring that the cartridges are aligned either to one side or to the other side as can be seen in FIG. 3. The cartridges 11, 12 are fed over the length of the magazine 10 in the interleaved arrangement shown in FIGS. 2 and 3. Only in the uppermost area are the cartridges 13, 14 forced by the internal contour of the magazine to a position which ensures that the respective firing rims are staggered, to precise in such a way that the firing rim of the uppermost cartridge 14 is located in front of that of the second-uppermost cartridge 13 seen in the firing direction of the weapon. This can be seen very well from the illustration in FIG. 2. Furthermore, the internal contour of the magazine also becomes narrower in the upward direction, as a result of which the uppermost cartridges are no longer interleaved, but are located with their axes approximately one above the other.

Figure 1:
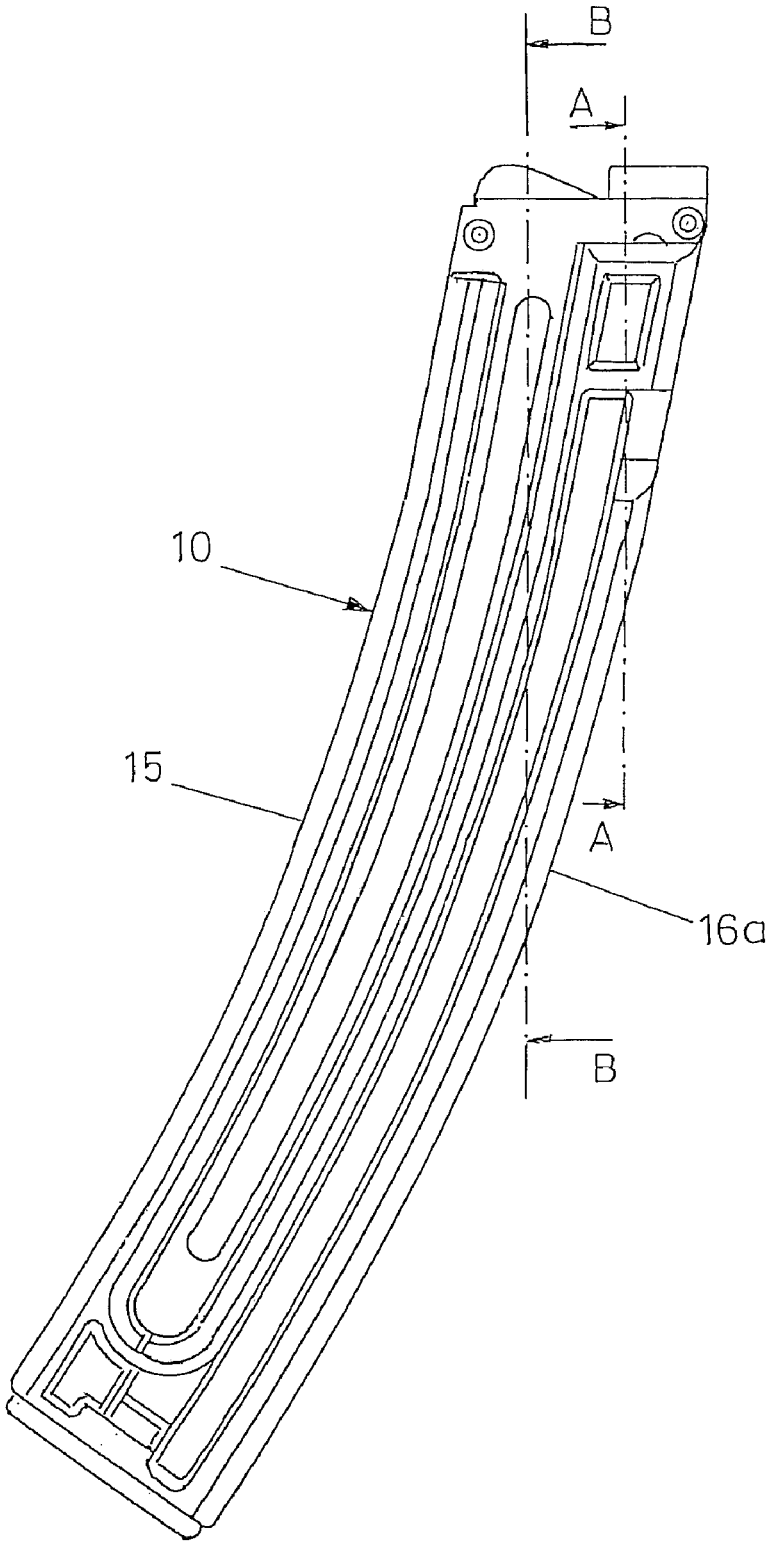
FIG. 1 shows a side view of a magazine according to the invention.
Figure 4:
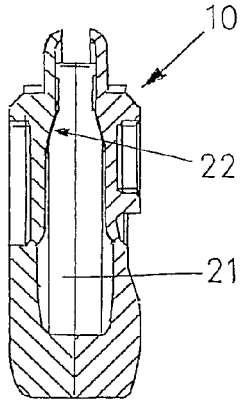
FIG. 4 shows a further section view longitudinally in the upper area through the magazine along the line A-A from FIG. 1, approximately on a plane which runs at right angles to the section shown in FIG. 2.

The section illustration in FIG. 4, which shows an approximately vertical longitudinal section A-A through the upper area of the magazine illustrated in FIG. 1, shows that the unobstructed width of the magazine in the lateral direction is greater in the area 21 located further below than in the uppermost area, where the separation and alignment of the cartridges takes place from both sides, reduced by ramps (inclines) 22 on both sides.

Figure 5:
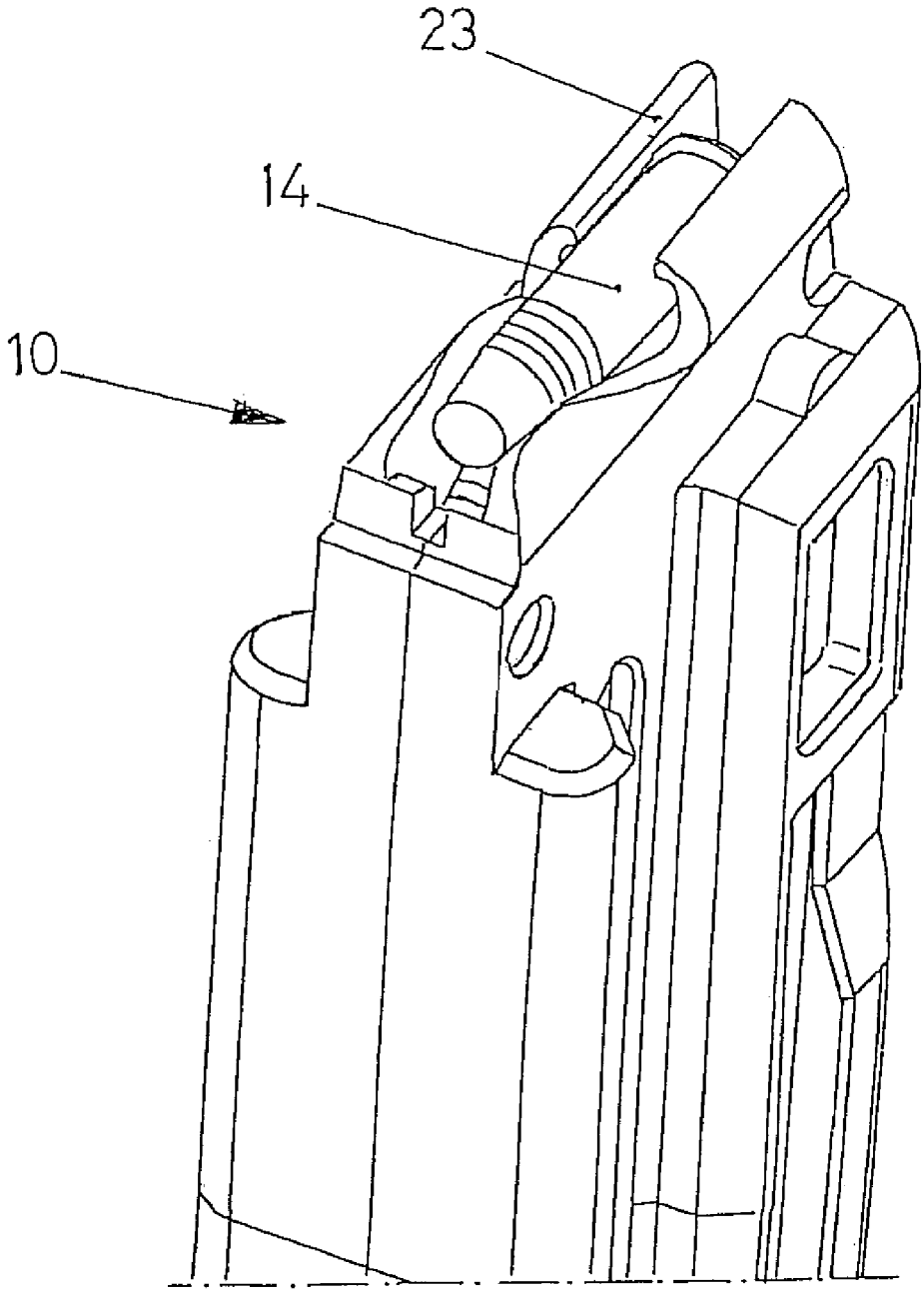
FIG. 5 shows a three-dimensional partial view of the upper area of the magazine with a cartridge inserted.

The following text refers to both FIGS. 5 and 6, and the internal contour and the rest of the configuration of the magazine in the uppermost area will be explained with reference to these figures. FIG. 5 shows a perspective illustration in which the uppermost cartridge 14 is held in a contour lip 23 which is integrally formed on the magazine, before it loaded through the breech of the weapon into the firing channel. As can be seen, the contour lip 23 holds and partially surrounds the cartridge 14 approximately as far as its central cylindrical area, while the cartridge tip is freer. The contour lip broadens inward toward its rear end, as a result of which there is sufficient space there to surround the firing rim, which is broader than the cartridge.

Figure 6:
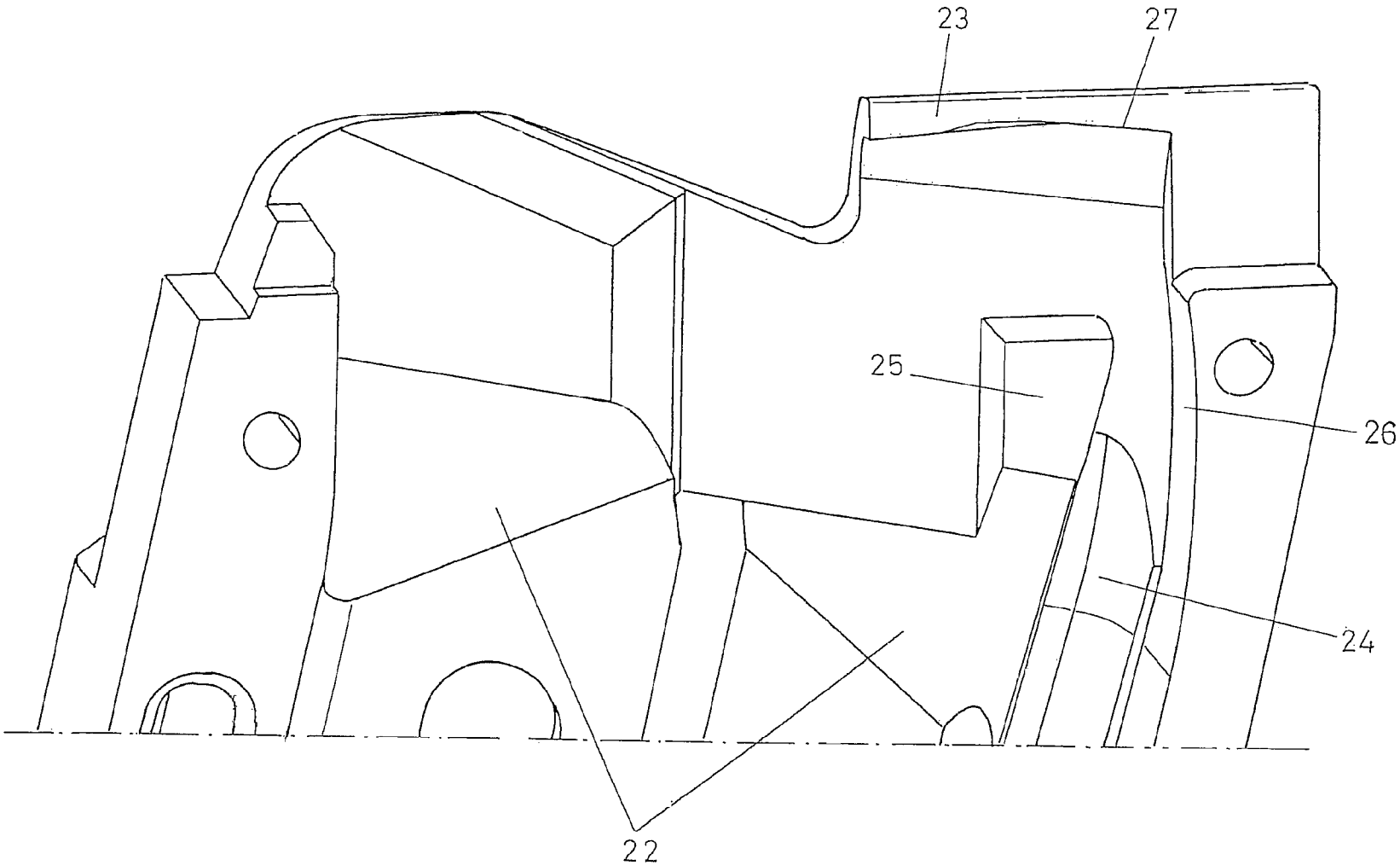
FIG. 6 shows a further schematic perspective partial view in the upper area of the magazine.

FIG. 6 shows an enlarged perspective illustration of the upper area of the magazine 10, from which some details can be seen more precisely. On the one hand, this shows the contour lip 23 as described above and the two ramps 22, which are also illustrated in FIG. 4, reduce the width of the internal area and force the cartridges into a position in which they are located one above the other. The firing rim 19 of the cartridges is located in a fillet 24 which is formed in the rear area of the magazine internal area and guides the firing rim, with FIG. 6 showing that this fillet 24 also becomes some what narrower toward the outlet end (that is to say toward the upper end of the magazine). During this process, the firing rim 19 of the uppermost cartridge passes a stud 25 which bounds the fillet 24 at the front, before the firing rim is then released and enters the area in which the contour lip 23 holds the cartridge (see also FIG. 5).

As can also be seen from FIG. 6, the fillet 24 is bounded at the rear by a guide web 26, on which the bottom of the firing rim of the cartridge rests. Since this guide web 26 follows a slightly curved line in its upper end area, the cartridge is pushed somewhat forward on emerging from the fillet 24, with the firing rim passing the stud 25. The contour lip may have a slight depression 27, whose bottom is approximately aligned with the guide web 26, as can be seen in FIG. 6, as a result of which the firing rim 19 of the uppermost cartridge 14 rests there when it has left the actual internal area of the magazine and is held by the contour lip 23. This position of the cartridge 14 is shown in FIG. 5. Since the contour lip becomes narrower in the forward direction, not only is the firing rim located between the two vanes of the contour lip 23, but the narrower central cylindrical area of the cartridge also rests on the contour lip 23 on both sides, and is held on its circumference there.

LIST OF REFERENCE SYMBOLS

10 Magazine
11 Cartridge
12 Cartridge
13 Cartridge
14 Cartridge
15 Outer contour of the magazine
16 Incline
16*a* Outer contour of the magazine
17 Incline
18 Tip of the cartridge
19 Firing rim
20 Center
21 Area located further below
22 Ramps
23 Contour lip

24 Fillet
25 Stud
26 Guide web
27 Depression

The invention claimed is:

1. A magazine for a handheld firearm, suitable for accommodating a plurality of cartridges which are transported in a guided movement by means of a feed within the magazine in the direction of a barrel, in order to be loaded individually in each case into the barrel of a firearm at the upper end of the magazine after each shot, with the cartridges being guided along a curved path in the magazine, the magazine comprising:

an internal contour of the magazine (10) that is conically tapered toward the upper end of the magazine in an upper transitional area by means of ramps (22) or inclines, wherein the internal contours of the magazine tapers to approximately the width of a cartridge, such that the cartridges are aligned, in an upper transitional area at a distance from the upper end of the magazine, starting from a broader area (21) which is located further below, wherein in the broader area successive cartridges assume an interlaced arrangement with crossing axes of the cartridges, wherein the internal width of the magazine (10) in the lateral direction in each case tapers gradually from both ends toward the center (20), wherein at least one fillet (24) is provided as a guide element for guidance of the firing rim (19) of the cartridge and at least partially holds the latter, and wherein a firing rim (19) of at least an uppermost cartridge (14) is guided by guide elements (24, 25, 26) in the magazine.

2. The magazine for a handheld firearm as claimed in claim 1, wherein the fillet (24) tapers toward its upper end.

3. The magazine for a handheld firearm as claimed in claim 1, wherein at least one stud (25) is provided in the upper area of the magazine (10), as a guide element for the firing rim (19) of the cartridge, and the firing rim engages behind said stud.

4. The magazine for a handheld firearm as claimed in claim 1, wherein, in order to achieve an interlaced arrangement of the cartridges (11, 12), the internal width of the magazine in a lateral direction is less in the center than in those areas in which the tips and firing rims (19) of each of the cartridges are located.

5. The magazine for a handheld firearm as claimed in claim 1, wherein, on both sides of the center (20) of the internal area of the magazine (10) there is a respective incline (16, 17) on the longitudinal side wall, such that the magazine has its smallest unobstructed width in the lateral direction approximately in the center (20).

6. The magazine for a handheld firearm as claimed in claim 1, wherein the fillet (24) is bounded at the rear by a guide web (26) on which the bottom of the firing rim (19) of the cartridge rests.

7. The magazine for a handheld firearm as claimed in claim 1, wherein a contour lip (23) is fitted as a guide element to the upper end of the magazine (10) and at least partially surrounds the circumference of at least one cylindrical section of the uppermost cartridge (14).

8. A handheld firearm, comprising a magazine (10) having the features of claim 1.

9. The magazine for a handheld firearm of claim 1, wherein the handheld firearm is a semi-automatic pistol.

* * * * *